US006692101B2

(12) United States Patent
Lodal et al.

(10) Patent No.: US 6,692,101 B2
(45) Date of Patent: Feb. 17, 2004

(54) METHOD AND APPARATUS FOR SERVICING AN INKJET PRINT HEAD

(75) Inventors: John Norman Lodal, Boise, ID (US); Roger Robert Sleger, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/133,616

(22) Filed: Apr. 26, 2002

(65) Prior Publication Data

US 2003/0202034 A1 Oct. 30, 2003

(51) Int. Cl.[7] ..... B41J 2/165
(52) U.S. Cl. ..... 347/33; 347/29; 347/30
(58) Field of Search ..... 347/22, 24, 28, 347/29, 30, 31, 32, 33

(56) References Cited

U.S. PATENT DOCUMENTS

| | | | | |
|---|---|---|---|---|
| 5,051,761 A | | 9/1991 | Fisher et al. | |
| 5,206,666 A | | 4/1993 | Watanabe et al. | |
| 5,432,539 A | * | 7/1995 | Anderson | 347/33 |
| 5,534,897 A | * | 7/1996 | Anderson et al. | 347/32 |
| 5,581,282 A | | 12/1996 | Okamura | |
| 5,587,729 A | | 12/1996 | Lee et al. | |
| 5,870,116 A | | 2/1999 | Kyoshima | |
| 5,914,734 A | * | 6/1999 | Rotering et al. | 347/28 |
| 5,946,009 A | * | 8/1999 | Youn | 347/32 |

FOREIGN PATENT DOCUMENTS

| | | | | |
|---|---|---|---|---|
| EP | 0856404 A1 | | 8/1998 | |
| EP | 0913263 A1 | | 5/1999 | |
| EP | 0856404 B1 | | 11/2002 | |
| EP | 0913263 B1 | | 5/2003 | |
| JP | 406234221 A | * | 8/1994 | 347/33 |

OTHER PUBLICATIONS

Merriam–Webster's Collegiate Dictionary, 10$^{th}$ edition, p. 1186, the definition of "swath".*

* cited by examiner

*Primary Examiner*—Shih-wen Hsieh

(57) ABSTRACT

An apparatus for servicing an inkjet print head includes a print head wiper for wiping the inkjet print head and a wiper cleaner adjacent to the print head wiper for cleaning the print head wiper.

14 Claims, 11 Drawing Sheets

METHOD AND APPARATUS FOR SERVICING AN INKJET PRINT HEAD

FIELD OF THE INVENTION

This invention relates to the field of inkjet printing and inkjet print heads. More specifically, the present invention relates to a servicing method and apparatus for an inkjet print head.

BACKGROUND OF THE INVENTION

Inkjet printing systems typically use thermal energy that is selectively produced by resistors located in ink-filled capillary channels near channel-terminating nozzles or orifices. The selectively applied thermal energy momentarily vaporizes the ink and forms bubbles. The bubbles expand, expel an ink droplet and propel it toward a recording medium, e.g. a sheet of paper.

Such a printing system may be incorporated in either a carriage-type printer or a page-width type printer. The carriage-type printer generally has a relatively small print head containing the ink channels and nozzles. The print head is usually connected to a disposable ink supply cartridge. The combination of the print head and cartridge assembly is reciprocated back and forth to print one line of information at a time on the recording medium. After each line is printed, the paper or other recording medium is stepped a distance equal to the height of the printed line, so that the next line can be printed. The procedure is repeated until the entire page is printed.

In contrast, the page-width printer has a stationary print head with a length equal to, or greater than, the width of the print medium. The paper, or other print medium, is moved past the page-width print head in a direction normal to the print head length and at a constant speed during the printing process. High-speed, page-width printers are used in a variety of applications. For example, Point-of-Sale (POS) printers are used to produce receipts at most retail stores.

Inkjet printing systems, however, are prone to several problems that adversely affect the quality and performance of the printing. Among these problems are (1) clogging of the print head nozzle caused by ink drying therein (which may occur due to a period of non-use), (2) adherence of dust to the face of the nozzle due to the moisture of the fluid ink around the nozzle, (3) leakage of ink from the nozzle, (4) bubbles and dust taken into the print head nozzle as a result of external causes such as vibration imparted to the print head and environmental changes occurring around the print head, and, finally, (5) contamination of the print head nozzles when the print head is not in use, caused by, for example, non-collapsing air bubbles. These problems, if not corrected, result in nozzles that cannot eject ink properly and the resulting print quality is degraded.

Several approaches have been proposed to address these problems associated with inkjet printing systems. Most of the proposals include a service station at one end of the printer to clean the print nozzles with a wiper element. However, these servicing systems locate the service station adjacent to the paper conveying system and require the print head to be moved alongside the paper conveying system. Consequently, it is difficult to use such servicing systems with a stationary page-width print head. Furthermore, most page-width stationary print heads are used with a continuous paper conveying system (e.g., a platen) that may block access between a service station and the stationary print head. An example of an inkjet print head servicing mechanism that includes a wiper element is shown in U.S. Pat. No. 5,051,761, which is hereby incorporated by reference in its entirety.

In addition, the wiping elements of typical print head service stations often become dirty themselves. After many servicing operations, it is not uncommon for the servicing wiper to become as dirty as the print head, and the wiping function no longer produces any useful result.

SUMMARY OF THE INVENTION

The present invention is directed to servicing an inkjet print head by cleaning the wiper that wipes the print head. In one embodiment of the invention, an apparatus for servicing an inkjet print head includes a print head wiper mounted on a rotatable shaft for wiping the inkjet print head and a wiper cleaner adjacent to the print head wiper for cleaning the print head wiper as the print head wiper rotates past and contacts the wiper cleaner. In another embodiment, a method of servicing an inkjet print head includes cleaning a wiper by moving the wiper into contact with a cleaner after the wiper has wiped the inkjet print head.

BRIEF DESCRIPTION OF THE DRAWINGS

The accompanying drawings illustrate embodiments of the present invention and are a part of the specification. Together with the following description, the drawings demonstrate and explain the principles of the present invention. The illustrated embodiments are examples of the present invention and do not limit the scope of the invention.

Throughout the drawings, identical reference numbers designate identical elements.

DETAILED DESCRIPTION OF THE PREFERRED EMBODIMENTS

Figure 1:
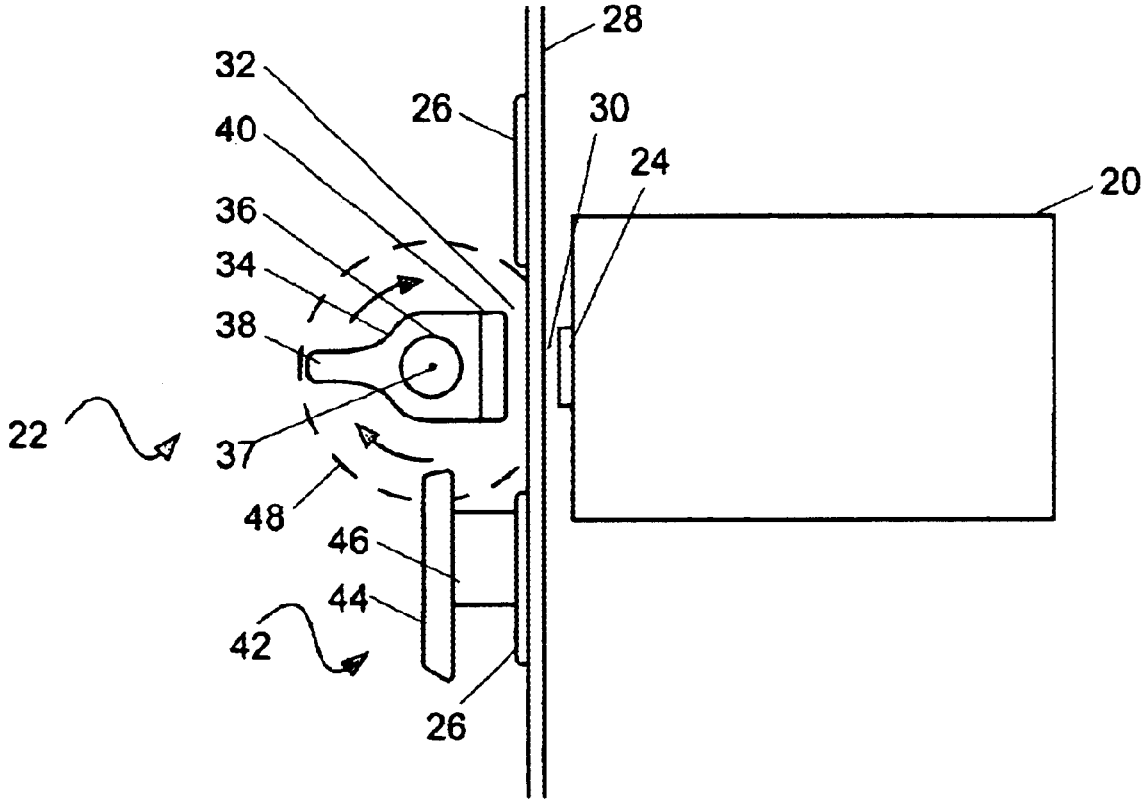
FIG. 1 is a side view of an inkjet print head servicing station shown in a first position according to one embodiment of the present invention.
Figure 10:
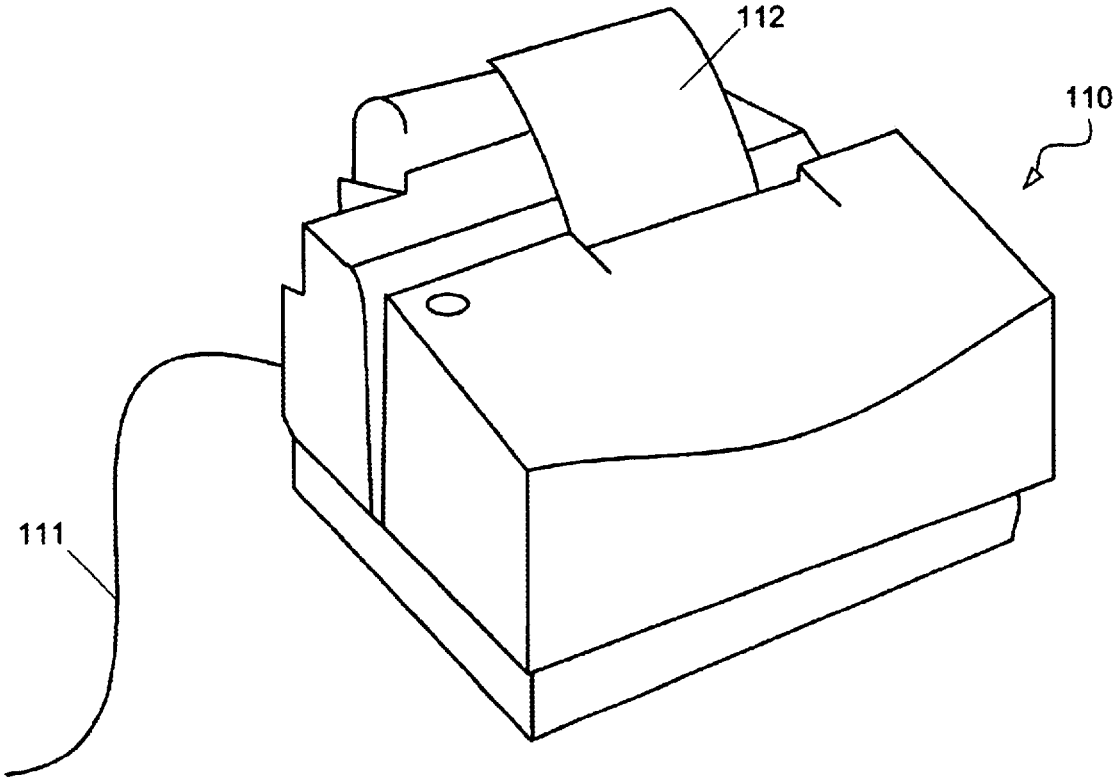
FIG. 10 is an illustration of a point-of-sale printer in which the present invention may be implemented.

As shown in the drawings, and in particular in FIG. 1, an inkjet print head 20 and associated inkjet print head servicing mechanism 22 are shown. Inkjet print head 20 is shown in the embodiment of FIG. 1 as a multi-nozzle, linear array, stationary inkjet print head. Such print heads are used, for example, in high-speed Point-of-Sale (POS) printers at retail outlets and other locations. A typical POS printer (110), in which the present invention is implemented, is illustrated in FIG. 10. As shown in FIG. 10, the POS printer (110) receives print job data over a connection (111) with a host device, such as a computer, cash register, etc. The printer (110) then prints, for example, a receipt, label or other documentation of a transaction on a print medium (112). Typically, the print medium (112) is a roll of paper which can be torn or cut as needed to separate print jobs. Multi-nozzle, linear array, stationary inkjet print heads are often used to print receipts and label checks or other drafts in POS printers. It will be understood, however, that inkjet print head 20 may also comprise a moving head as are common in many other printer applications.

Multi-nozzle linear array print head 20 may have hundreds or thousands of in-line inkjet nozzles (not shown) disposed along an orifice surface 24. Orifice surface 24 may span a distance of about 0.5 cm to about 15 cm in some embodiments, a distance of about 3 cm to about 10 cm other embodiments, and about 6.35 cm in the embodiment shown in FIG. 1 in, for example, a POS printer. Inkjet print heads like the multi-nozzle linear array print head 20 are available from many sources, including Hewlett-Packard Co.

Inkjet print head 20 is shown positioned adjacent a print media guide 26. Print media guide 26 controls the direction of a print media advanced through the printer. In the embodiment shown in FIG. 1, the print media is preferably paper 28.

Print media guide 26 also maintains a spacing 30 between the orifice surface 24 and the print media, such as paper 28. The maintenance of spacing 30 contributes to consistent image quality created by inkjet print head 20.

In some embodiments, the spacing 30 may include room for insertion of a check or other draft for printing sales, deposit, or other information that a retailer may want to print on a customer's check.

Located adjacent inkjet print head 20 is print head servicing mechanism 22. An opening 32 in print media guide 26 facilitates communication between inkjet print head 20 and print head servicing mechanism 22. Print head servicing mechanism 22 is designed to service the nozzles of orifice surface 24 to help maintain the health of inkjet print head 20 by keeping them clean.

Print head servicing mechanism 22, as shown in the embodiment of FIG. 1, includes a first element 34 mounted to a rotatable shaft 36. Rotatable shaft 36 may be made of stainless steel or other suitable materials well known to those of skill in the art having the benefit of this disclosure. Rotatable shaft 36 may be continuously rotatable a full 360 degrees or more, or it may be rotatable only a fraction of 360 degrees and then returnable to an original position.

Rotatable shaft 36 may be connected at one or both ends to a drive mechanism (not shown). The drive mechanism rotates shaft 36 about an axis 37 to selective angular positions. Stepper motors and other shaft driving mechanisms with selectable angular positioning capability are well known to those of skill in the art having the benefit of this disclosure. Rotatable shaft 36 may be mounted to a printer housing (not shown) or other portion of a printer.

First element 34, which is mounted to rotatable shaft 36, includes a wiper 38 or other protrusion or swath that, in the present embodiment, extends radially from the rotatable shaft 36. Wiper 38 may be made of rubber or other pliable or elastomeric materials that facilitate effective wiping of ink and debris from orifice surface 24.

Figure 1A:
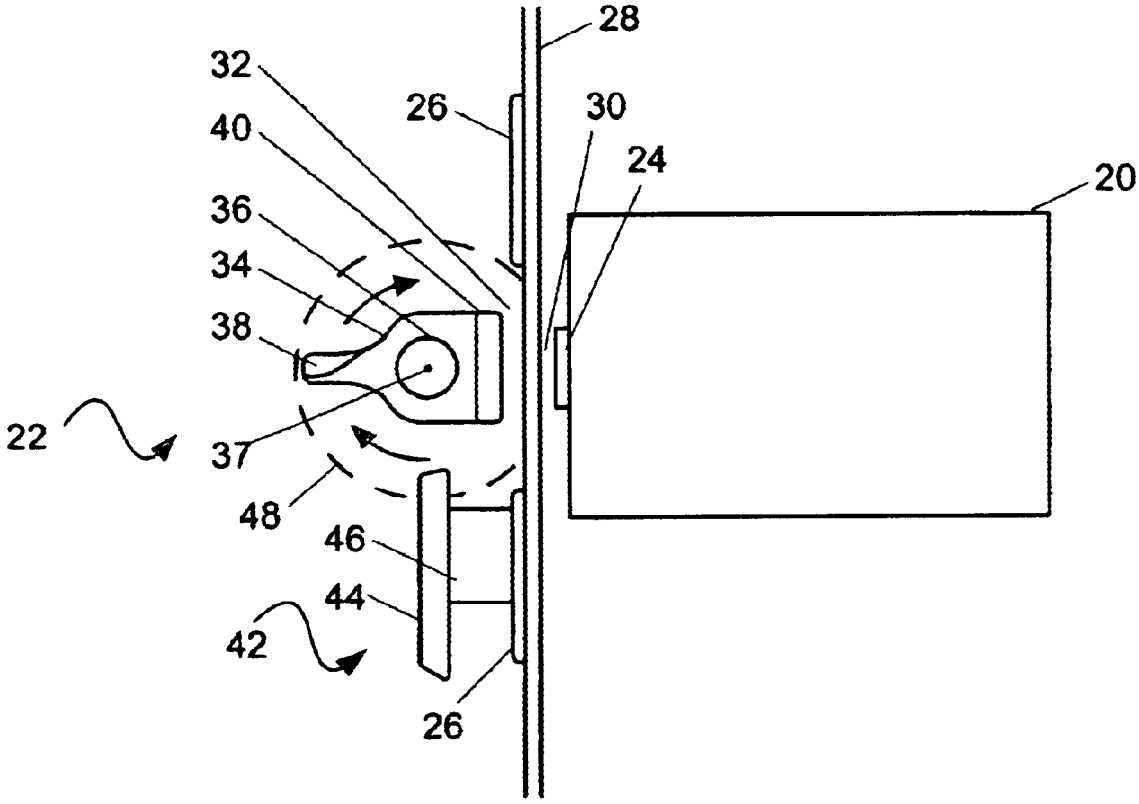
FIG. 1*a* is a side view of an inkjet print head servicing station according to another embodiment in which the wiper has a twisted or helical shape.

Wiper 38 may extend radially from rotatable shaft 36 in a substantially straight manner as in the configuration shown in FIG. 1, but this is not necessarily so. Wiper 38 may also include a twist or partial helical shape, as shown in FIG 1*a* to facilitate wiping across orifice surface 24 with less torque than may otherwise result with a straight wiper. The wiping of orifice surface 24 by wiper 38 is discussed in more detail below.

First element 34 may also include an ink absorber 40. In the embodiment shown as FIG. 1, ink absorber 40 is integrally formed into first element 34. Ink absorber 40 is preferably located on first element 34 diametrically opposite of wiper 38 in the embodiment shown. This arrangement facilitates balance of first element 34, but this is not necessarily so. Ink absorber 40 and wiper 38 may be arranged at any angle with respect to one another about rotatable shaft 36, or they may be separate components altogether.

Ink absorber 40 may be constructed of any material known for good absorption properties, including, but not limited to, sponges, ink pads, and the like.

Print head servicing mechanism 22 may also include a second element 42 for cleaning wiper 38 when wiper 38 becomes dirty. Wipers (e.g., 38) may become at least as contaminated and dirty as orifice surface 24 after several uses and thus be rendered ineffective without the advantage of a second element 42 for cleaning wiper 38.

Second element 42 may function as a wiper cleaner to keep wiper 38 in condition for effectively cleaning orifice surface 24. In the embodiment shown in FIG. 1, second element 42 is preferably mounted to a side of the print media guide 26 opposite the side that guides the print media 28. It will be understood by those of skill in the art having the benefit of this disclosure, however, that second element 42 may be attached to other components of a printer (not shown) as well.

Second element 42 may include a wiping blade 44 for scraping ink and debris from wiper 38 to keep wiper 38 in condition for maximum effectiveness in cleaning orifice surface 24. Second element 42 may also include an ink absorption medium 46 for collecting and holding ink and debris scraped from wiper 38 by wiping blade 44.

In the embodiment of FIG. 1, ink absorption medium 44 is a sponge or other absorbent material and is attached between print media guide 26 and wiping blade 44.

In an alternative embodiment, one or more additional wiper cleaners similar or identical to second element 42 may be mounted adjacent first element 34 to further clean wiper 38.

Figure 2:
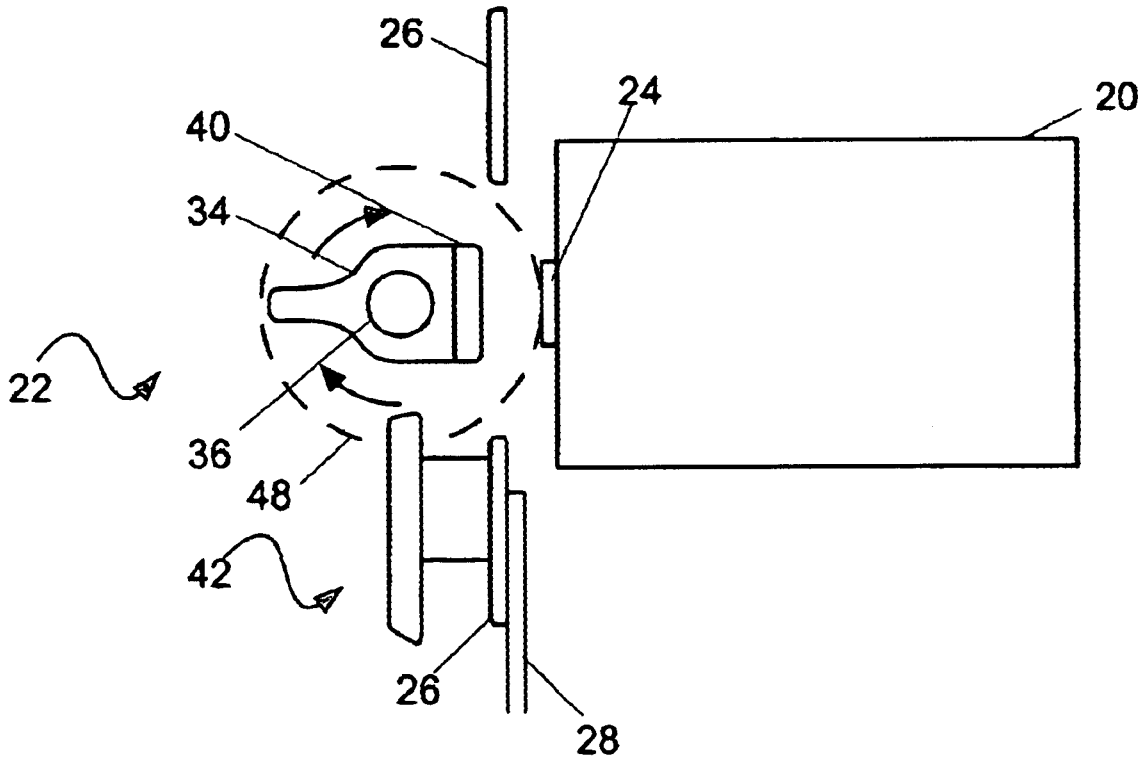
FIG. 2 is a side view of the inkjet print head servicing station of FIG. 1 shown with a print media backed away from the print head.
Figure 3:
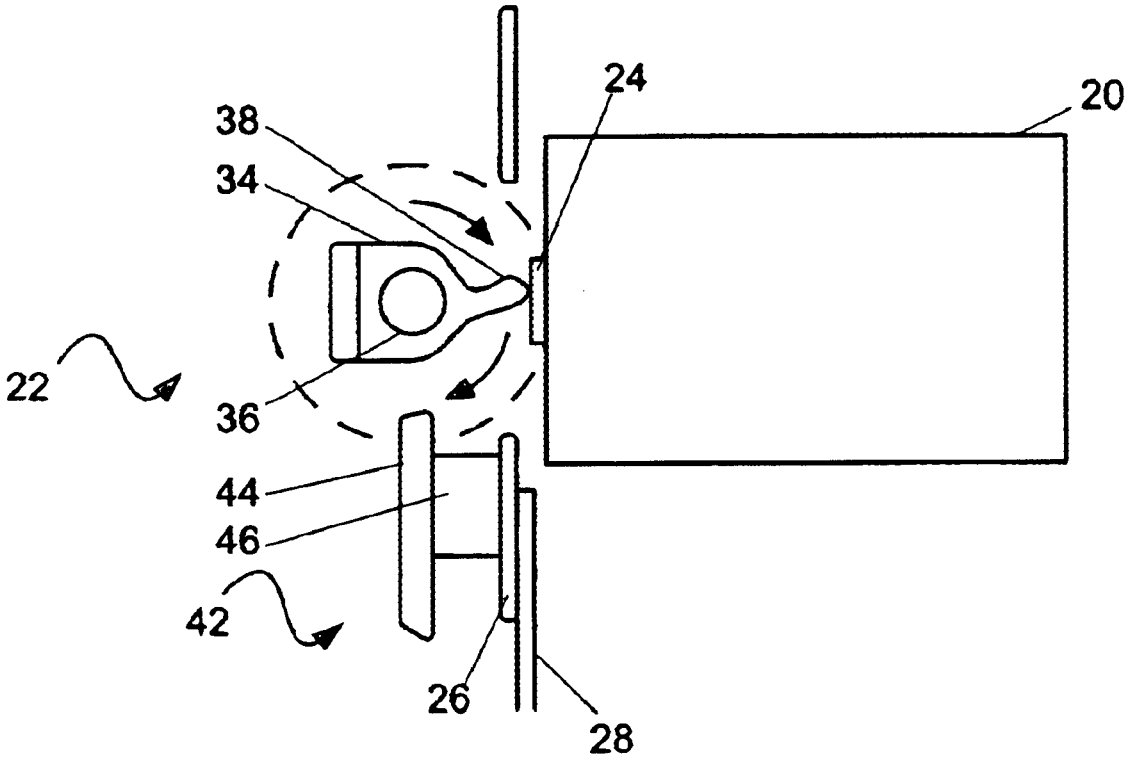
FIG. 3 is a side view of the inkjet print head servicing station of FIG. 1 shown in a second position.

Operation of servicing mechanism 22 may be described below with reference to FIGS. 1–3. FIG. 1 displays servicing mechanism 22 in a first or printing position with ink absorber 40 adjacent paper 28. Paper 28 may be receiving ink from inkjet printing head 20 via the nozzles in orifice plate 24.

As referred to above, first element 34 is mounted about a periphery of rotatable shaft 36. Rotatable shaft 36 is capable of rotating first element 34 along a generally circular path represented by line 48. Rotatable shaft 36 may be rotatable in a single direction such as the clockwise direction indicated in the figures, or it may be rotatable in two directions (e.g. clockwise and counter-clockwise).

As orifice surface 24 or the nozzles contained therein become dirty, paper 28 or any other print media may be backed out of, or removed from, print media guide 26 in order to expose orifice surface 24 to print head servicing mechanism 22. As shown in FIG. 2, ink absorber 40 is adjacent print orifice surface 24 with no print media to block communication between ink absorber 40 and inkjet print head 20. In the position shown in FIG. 2, inkjet print head 20 may idly eject or "spit" ink from the inkjet nozzles into ink absorber 40. The spitting of ink from inkjet print head 20 may clean clogged or dirty nozzles. Ink Absorber 40 collects the ejected ink and prevents the ink from migrating into other parts of the printing mechanism.

After the ink spitting operation, orifice surface 24 may be wiped to remove the excess ink and debris from the nozzles and the orifice surface itself. To accomplish the wiping of orifice surface 24, rotatable shaft 36 is rotated (in the present embodiment in a clockwise manner) such that wiper 38 contacts orifice surface 24 as shown in FIG. 3. Wiper 38 may comprise a helical protrusion in order to reduce the wiping torque required of rotatable shaft 36 by spreading the contact of the wiper over a greater angular motion as compared to a straight wiper. However, wiper 38 may also be substantially straight as shown in FIGS. 1–3. Wiper 38 may be sized to flexibly contact the full extent of orifice surface 24 as the wiper is rotated past the orifice surface.

As wiper 38 swaths across orifice surface 24, it may become saturated with the ink and debris that was formerly present on the orifice surface. Advantageously, as rotatable shaft 36 continues to rotate, wiper 38 will contact wiping blade 44 of second element 42. Second element 42 is arranged adjacent to first element 34 such that wiper blade 44 interferes with the normal rotation path 48 that wiper 38 takes as wiper 38 rotates with rotatable shaft 36. Because of the interference between wiper 38 and wiping blade 44, the ink and debris present on wiper 38 are scraped therefrom by wiping blade 44. As the ink and debris is scraped from wiper 38, it will tend, under the influence of gravity to slide down the blade 44 and is preferably collected by ink absorbing media 46 to prevent the migration of the ink and debris scraped from wiper 38 to other portions of the printer.

Rotatable shaft 36 may continue to rotate to the original position shown in FIG. 1 and the paper 28 or other print medium may be reinserted along guide 24 as desired.

Figure 4:
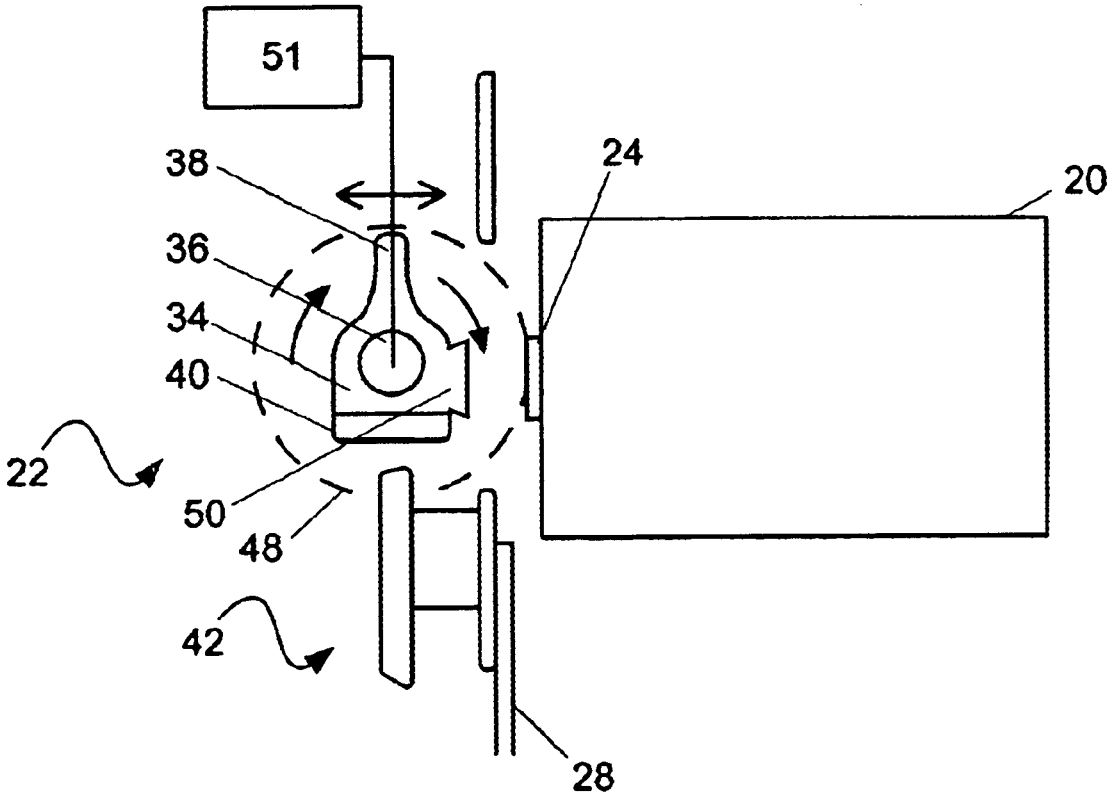
FIG. 4 is a side view of an inkjet print head servicing station according to another embodiment of the present invention.

In another embodiment shown in FIG. 4, first element 34 may further include an inkjet print head cap 50 located about the periphery of rotatable shaft 36 with wiper 38 and ink absorber 40. In this embodiment, after inkjet print head 20 has spit into ink absorber 40 and has been wiped by wiper 38, the inkjet print head 20 may be capped by inkjet print head cap 50 to keep the nozzles from drying out or becoming contaminated during periods of non-use. Inkjet print head cap 50 may be made of a stiff rubber or other elastomeric material such that as rotatable shaft 36 rotates, inkjet print head cap 50 engages, is deformed, and then hermetically seals print head 20 at a particular position of rotatable shaft 36.

In addition, in some embodiments rotatable shaft 36 may include linear driving means 51 to move inkjet print head cap 50 into and out of engagement with print head 20 instead of relying solely on rotation of rotatable shaft 36 for capping print head 20 with a hermetic seal.

Figure 5:
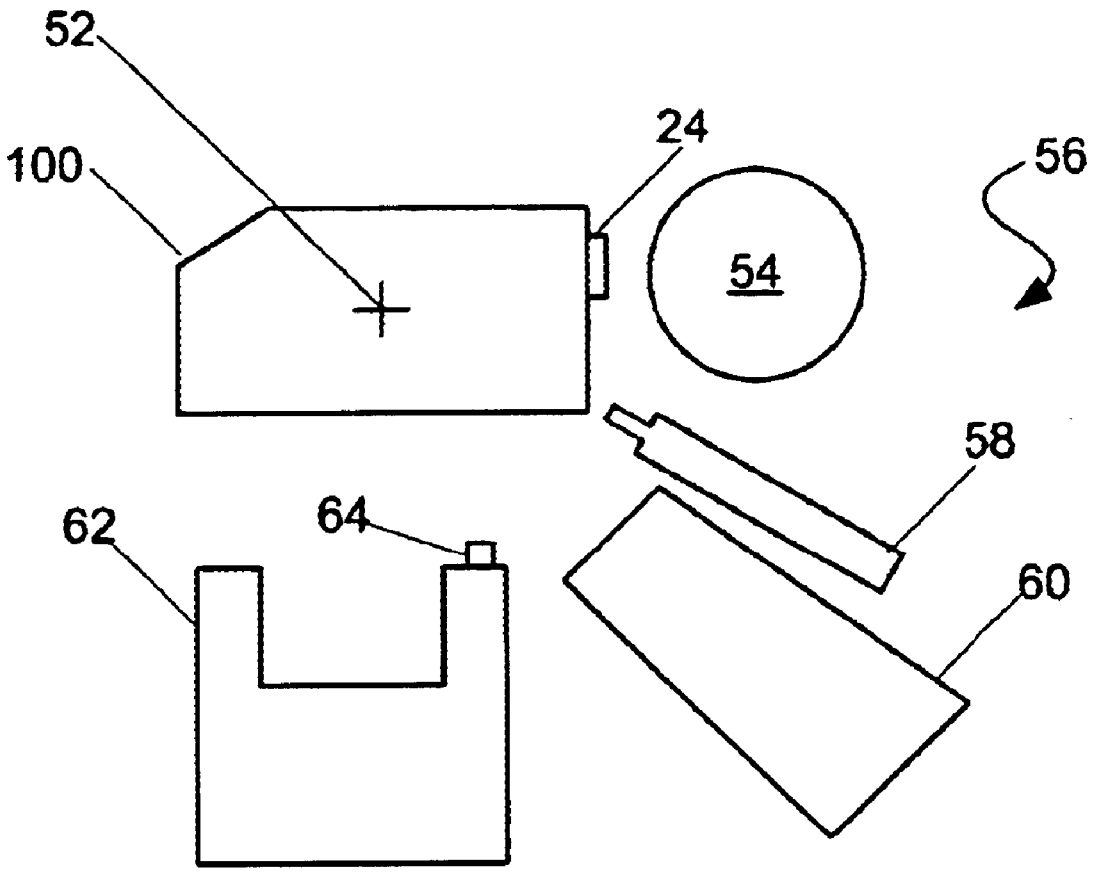
FIG. 5 is a side view of an inkjet print head servicing station shown in a first position according to another embodiment of the present invention.

Turning next to FIG. 5, another embodiment of the present invention is disclosed. According to the embodiment of FIG. 5, inkjet print head 100 may be rotatably mounted to a rotor 52. Adjacent inkjet print head 100 may be a paper platen 54 such as is common in many POS printers.

The embodiment of FIG. 5 also includes an inkjet print head servicing mechanism 56 to clean and cap inkjet print head 100. Inkjet print head servicing mechanism 56 may include a first wiper 58, a spittoon 60, and a cap 62. The first wiper 58, spittoon 60, and cap 62 may be mounted to a printer housing (not shown) or other printer components. First wiper 58, spittoon 60, and cap 62 may be fixed in position relative to print head 100 by any known fastening means.

According to the embodiment of FIG. 5, cap 62 may include a second wiper 64 integrated with cap 62. First and second wipers 58 and 64 may be made of rubber or other elastomeric material to facilitate flexible contact with orifice surface 24 of print head 100. Further, one or both of first and second wipers 58 and 64 may include a partial helical shape to reduce torque as print head 100 is rotated past each.

As discussed above, many printers, including high-speed POS printers, may include a print medium feeding mechanism or a continuous-feed print medium mechanism (such as a paper roll on platen 54) that blocks communication between inkjet print head 100 and an inkjet print head servicing mechanism such as servicing mechanism 56.

With inkjet print head 100 rotatably mounted to rotor 52, inkjet print head 100 may advantageously be rotated to other positions to communicate with service mechanism 56 without withdrawing the print media from the printer.

FIG. 5 displays inkjet print head 100 in a first or printing position where the orifice surface 24 is directed at a print medium and print medium feeding mechanism, such as platen 54. However, as orifice surface 24 and the associated nozzles become dirty, inkjet print head 100 may rotate about rotor 52 to clean the orifice surface.

Figure 6:
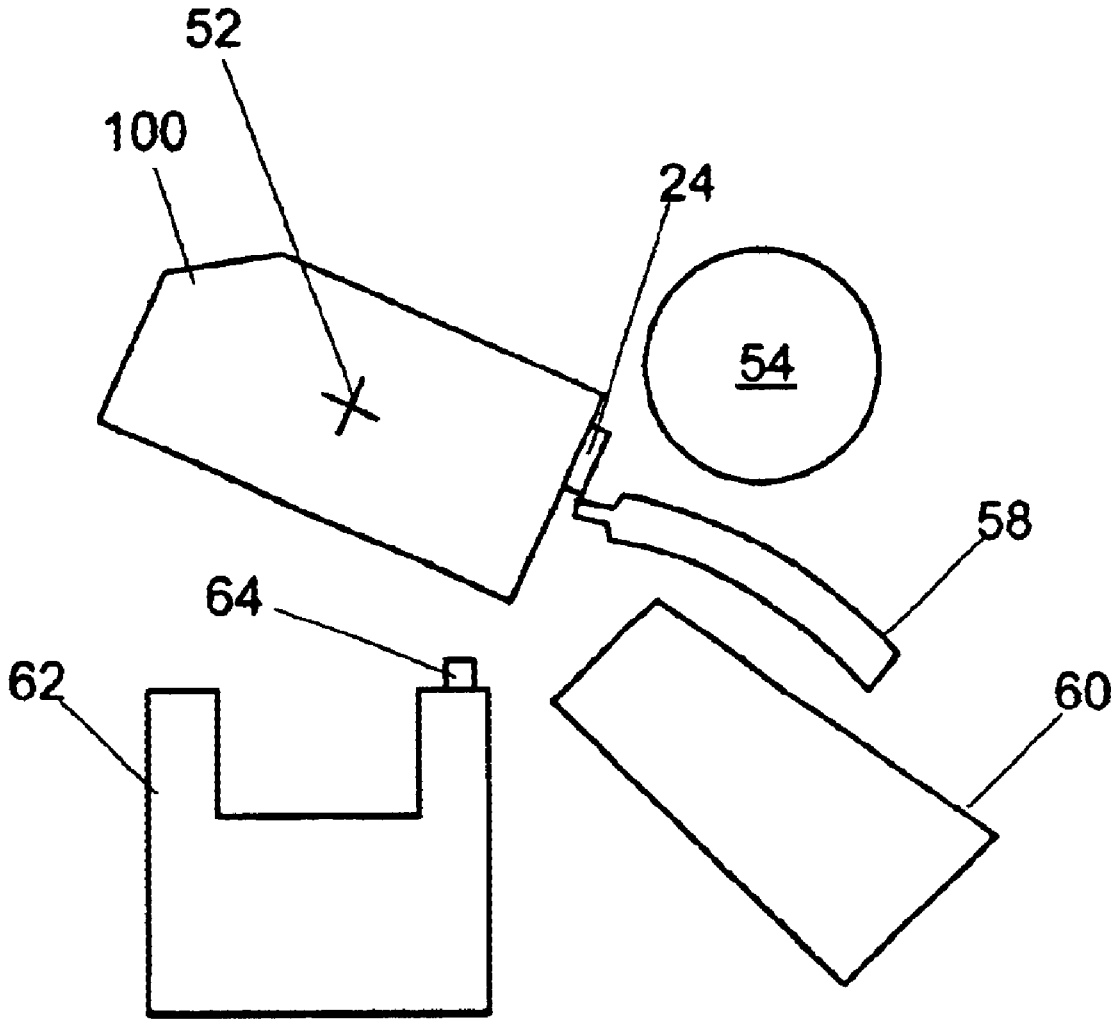
FIG. 6 is a side view of the inkjet print head servicing station of FIG. 5 shown in a partially rotated position.

Referring to FIG. 6, print head 100 may be rotated past first wiper 58 to wipe ink and debris from orifice surface 24. First wiper 58 interferes with the normal path of print head 100 such that contact is made between orifice surface 24 and first wiper 58 as print head 100 is rotated past first wiper 58. First wiper 58 may be made of a flexible elastomer such as rubber that will deform to allow rotation of the print head 100 while wiping orifice surface 24 as print head 100 is rotated past first wiper 58. First wiper 58 will spring back to a normal position as shown in FIG. 5 after print head 100 has rotated a sufficient angle past first wiper 58 such that there is no longer contact between orifice surface 24 and first wiper 58.

Figure 7:
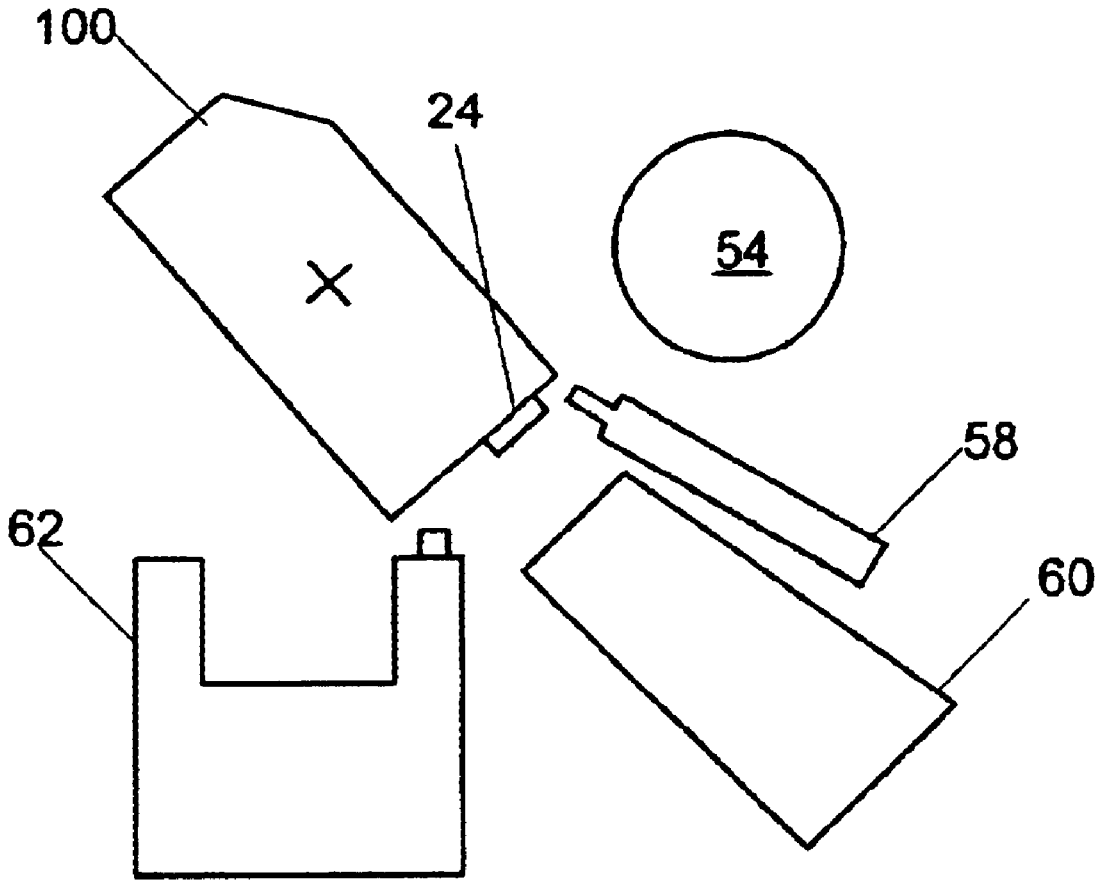
FIG. 7 is a side view of the inkjet print head servicing station of FIG. 5 shown in a second position.

Following the cleaning of orifice surface 24 by first wiper 58, print head 100 may rotate to a second position as shown in FIG. 7. Print head 100 may stop at the second position with the print head facing spittoon 60. Spittoon 60 may be an ink container with an absorbent material to collect and hold ink expelled by print head 100 when print head 100 is facing the spittoon. As discussed above, ink may be idly ejected from the nozzles of print head 100 to clean them from clogs and debris that may accumulate during normal printing operations.

After ejecting ink into spittoon 60 to clean the nozzles, print head 100 may continue to rotate and contact second wiper 64, which is preferably integrated with cap 62, but may be a separate element similar to first wiper 58. Second wiper 64 may wipe the excess ink from orifice surface 24 after print head 100 has expressed ink into spittoon 60.

Figure 8:
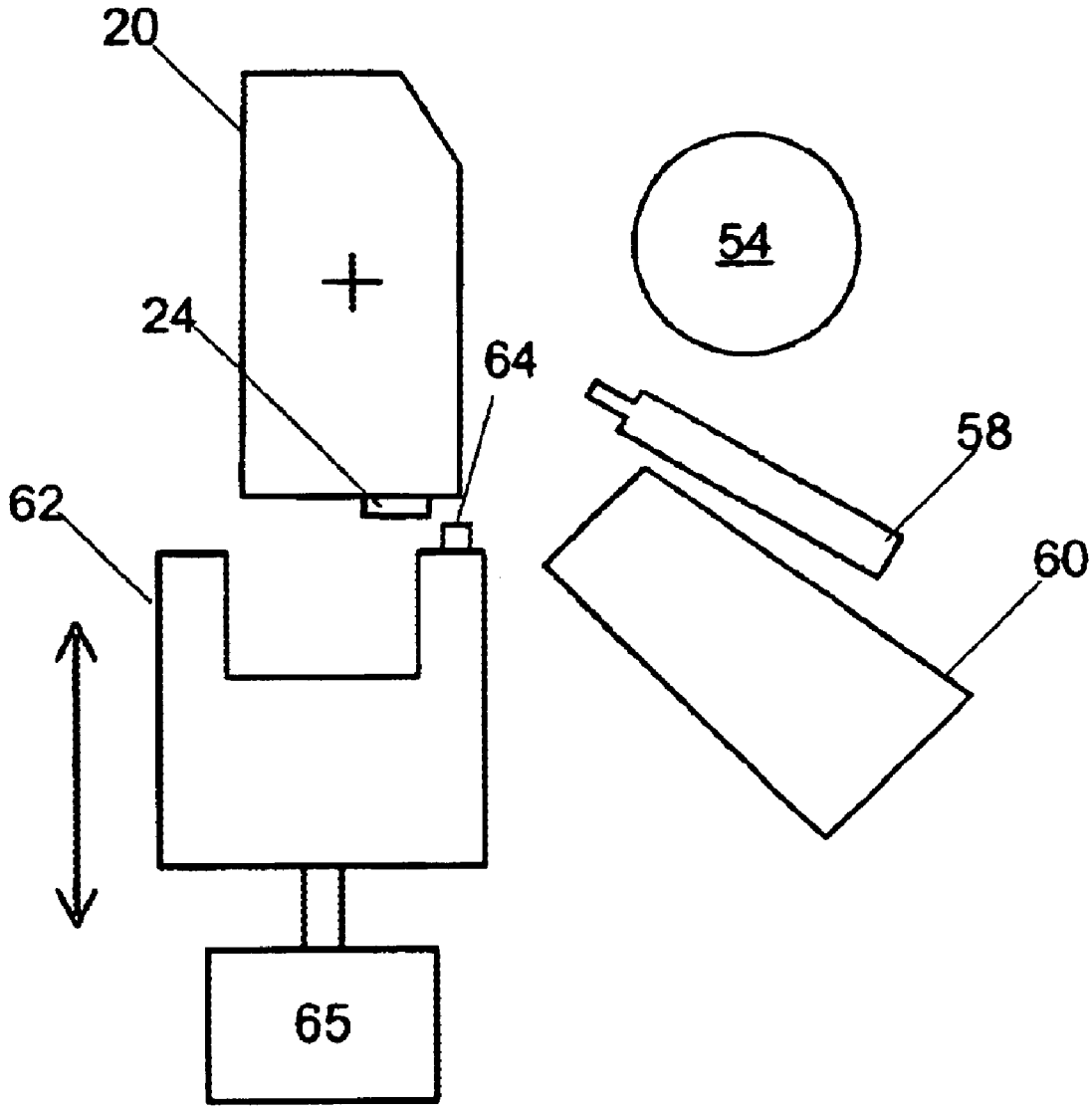
FIG. 8 is a side view of the inkjet print head servicing station of FIG. 5 shown in a third position.

Alternatively, there may be a clearance between orifice surface 24 and second wiper 64 such that print head 100 may rotate freely to a third position shown in FIG. 8 directly facing cap 62. In such an embodiment, cap 62 may include a linear drive mechanism 65 capable of movement in at least two directions. The linear drive mechanism may move cap 62 toward print head 100 until second wiper 64 engages orifice surface 24. After second wiper 64 engages orifice surface 24, the drive mechanism 52 may move second wiper 64 across orifice surface 24 to clean the ink and debris therefrom.

When the ink and debris has been wiped from orifice surface 24 (which may be accomplished as print head 100 rotates past second wiper 64 or as second wiper 64 is moved along the orifice surface by a drive mechanism), print head 100 and/or cap 62 may be moved to reach the position shown in FIG. 8 in which print head 100 and cap 62 are directly facing one another. Cap 62 may then be urged linearly toward print head 100 by drive mechanism 65 to engage print head 100 and hermetically seal orifice surface 24. Linear drive mechanisms for movement of cap 62 as described above are readily available to those of skill in the art having the benefit of this disclosure.

In the embodiment shown in FIGS. 5–8, print head 100 may rotate approximately ninety degrees (90°) from the first position shown in FIG. 5 to the third position shown in FIG. 8. However, the angular rotation angle may be larger or smaller than the ninety-degree traversal shown in the present embodiment. The first position of print head 100 as shown in FIG. 5 facing a print media on platen 54 and the third position of print head 100 shown in FIG. 8 facing cap 62 may each be precisely located by the use of hard stops (not shown) between the two positions.

When a user is ready to print again, cap 62 may be moved out of engagement with print head 100, and the print head 100 may then be rotated either clockwise or counterclockwise back to the first or printing position as shown in FIG. 5.

Figure 9:
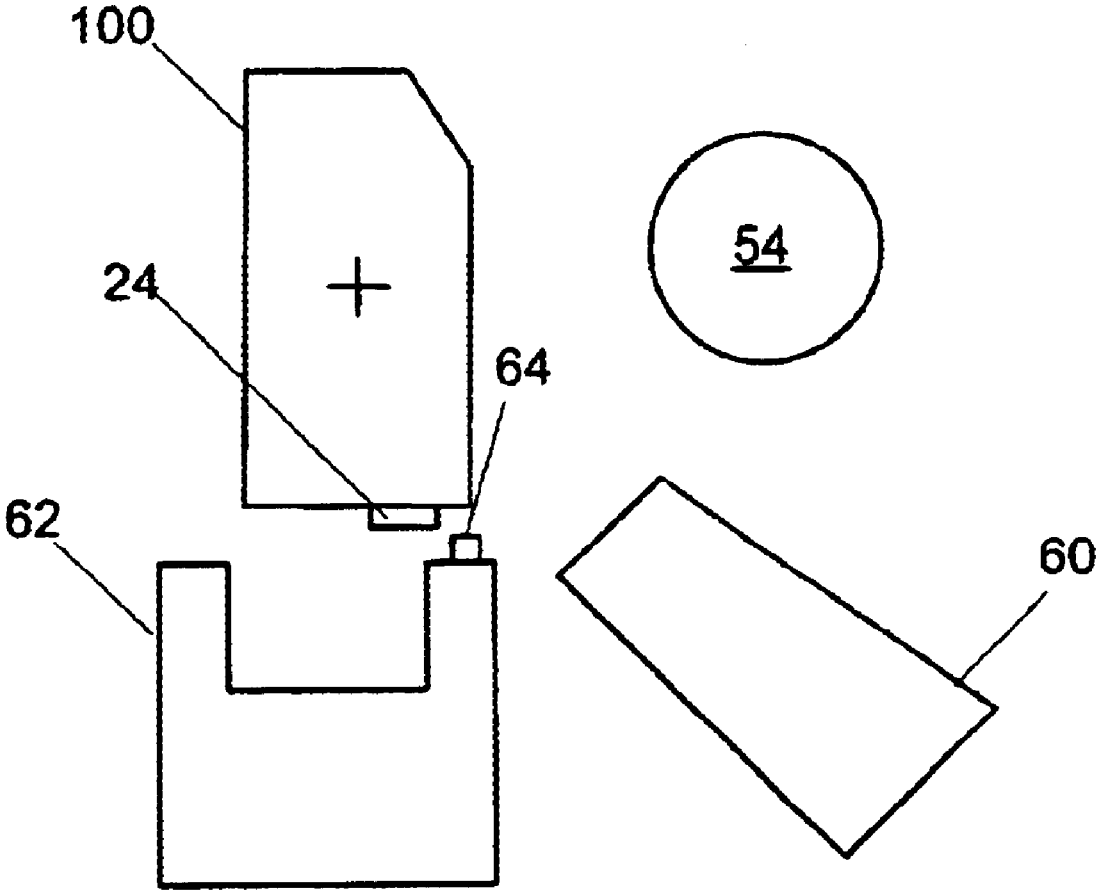
FIG. 9 is a side view of an inkjet print head servicing station according to another embodiment of the present invention.

In another embodiment shown in FIG. 9, the first wiper 58 shown in previous embodiments is omitted. Rather, the wiper 64 disposed on the cap 62 performs the only wiping function after print head 100 has rotated past spittoon 60. According to this embodiment, print head 100 may rotate from a printing position directly to a second position facing spittoon 60 without being wiped. Print head 100 may then eject ink through orifice surface 24 into spittoon 60 to clean the print head nozzles (not shown). Following the ejection of ink through orifice surface 24, print head 100 may rotate past wiper 64 to wipe the excess ink and debris from orifice surface 24. Print head 100 may continue to rotate into the third position as shown in FIG. 9 facing cap 62, which may hermetically seal orifice surface 24.

What is claimed is:

1. An apparatus for servicing an inkjet print head comprising:

a print head wiper adjacent to said print head for wiping said inkjet print head, wherein said print head wiper is mounted on a rotatable shaft for wiping said inkjet print head as said shaft rotates;

a wiper cleaner adjacent to said print head wiper for cleaning said print head wiper, wherein said wiper cleaner adjacent to said print head wiper cleans said print head wiper as said print head wiper rotates past and contacts said wiper cleaner; and an ink absorber integrated with said print head wiper and mounted on said rotatable shaft, wherein said ink absorber is mounted on said shaft opposite said print head wiper.

2. An apparatus for servicing an inkjet print head comprising:

a print head wiper adjacent to said print head for wiping said inkjet print head, wherein said print head wiper is mounted on a rotatable shaft for wiping said inkjet print head as said shaft rotates; and a wiper cleaner adjacent to said print head wiper for cleaning said print head wiper, wherein said wiper cleaner adjacent to said print head wiper cleans said print head wiper as said print head wiper rotates past and contacts said wiper cleaner;

wherein said wiper cleaner comprises a fixed element spaced from said print head wiper such that said wiper cleaner interferes with a path of rotation of said print head wiper when said print head wiper is rotated about said rotatable shaft past said wiper cleaner; and wherein said wiper cleaner is mounted to a print media guide of an inkjet printer.

3. The apparatus of claim 2, wherein said wiper cleaner further comprises an ink absorbing media to absorb ink that is wiped from said print head wiper.

4. An apparatus for servicing an inkjet print head comprising:

a print head wiper adjacent to said print head for wiping said inkjet print head; and a wiper cleaner adjacent to said print head wiper for cleaning said print head wiper;

wherein said print head wiper comprises a rubber helical protrusion to reduce wiping torque.

5. An inkjet print head servicing mechanism comprising:

a first element rotatably mounted to a shaft with a protrusion extending therefrom for cleaning a stationary inkjet print head; and a second element for cleaning the first element;

wherein the protrusion comprises a helical shape to reduce rotation torque as said protrusion contacts said second element.

6. The servicing mechanism of claim 5, wherein said first element further comprises an ink absorption pad for collecting ink expelled by said inkjet print head.

7. The servicing mechanism of claim 6, wherein said first element further comprises an inkjet print head cap for capping said inkjet print head.

8. The servicing mechanism of claim 7, wherein said protrusion, ink absorption pad, and inkjet print head cap are spaced about a periphery of said first element.

9. The servicing mechanism of claim 5, wherein said second element further comprises a wiping blade for cleaning said protrusion of said first element and an ink absorption medium for collecting ink cleaned from said protrusion.

10. An apparatus for servicing an inkjet printer comprising:

a print head rotatably mounted to a rotor for selectively positioning said print head in at least three positions;

a first wiper disposed adjacent to said print head for wiping said print head as said print head is rotated past the wiper;

a spittoon disposed adjacent to said first wiper for collecting ink ejected from said print head; and a cap disposed adjacent to said spittoon for hermetically sealing said print head.

11. The apparatus of claim 10, wherein said first wiper is fixed in position relative to said print head.

12. The apparatus of claim 10, further comprising a second wiper integrated with said cap for wiping said print head after said print head ejects ink into said spittoon.

13. The apparatus of claim 10, wherein said at least three positions comprise a printing position, a spitting position, and a capping position.

14. The apparatus of claim 10, wherein said print head may be cleaned without withdrawing a print media from said inkjet printer.

* * * * *